US006824447B2

(12) United States Patent
Takahashi et al.

(10) Patent No.: US 6,824,447 B2
(45) Date of Patent: Nov. 30, 2004

(54) PERFORATED-TRANSPARENT POLISHING PAD

(75) Inventors: Shogo Takahashi, Yamato Koriyama (JP); Hajime Shimizu, Yamato Koriyama (JP)

(73) Assignee: Rodel Nitta Corporation, Nara (JP)

( * ) Notice: Subject to any disclaimer, the term of this patent is extended or adjusted under 35 U.S.C. 154(b) by 49 days.

(21) Appl. No.: 10/331,012

(22) Filed: Dec. 27, 2002

(65) Prior Publication Data

US 2004/0127145 A1 Jul. 1, 2004

(51) Int. Cl.[7] ..... B24D 49/12
(52) U.S. Cl. ..... 451/6; 451/533; 51/298
(58) Field of Search ..... 451/6, 526, 527, 451/533, 534; 51/298, 293

(56) References Cited

U.S. PATENT DOCUMENTS 5,020,283 A * 6/1991 Tuttle ..... 451/550
5,605,760 A * 2/1997 Roberts ..... 428/409
6,014,218 A * 1/2000 Bradl et al. ..... 356/630
6,068,540 A * 5/2000 Dickenscheid et al. ..... 451/6
6,171,181 B1 * 1/2001 Roberts et al. ..... 451/527
6,358,130 B1 3/2002 Freeman et al.
6,458,014 B1 * 10/2002 Ihsikawa et al. ..... 451/6
6,524,164 B1 2/2003 Tolles

* cited by examiner

*Primary Examiner*—Robert A. Rose
(74) *Attorney, Agent, or Firm*—Blake T. Biederman

(57) ABSTRACT

The method forms a transparent polishing pad by first step forming a plurality of openings through a disk-shaped pad body. The plurality of openings is distributed about the disk-shaped pad body and a transparent window within a portion of the pad body and the transparent window. Then sealing the openings in the transparent window with a transparent material allows transport of polishing fluids through the openings in the disk-shaped pad body and prevents transport of the polishing fluids through the transparent window.

7 Claims, 2 Drawing Sheets

PERFORATED-TRANSPARENT POLISHING PAD

FIELD OF THE INVENTION

The present invention relates to a polishing pad used for a material to be polished such as semiconductors, electronic components, and the like. More specifically, it relates to a polishing pad for use in a polishing machine utilizing chemical-mechanical polishing (CMP) technology wherein a transparent window member is formed on a part of the polishing pad so as to let a laser beam or visible light pass therethrough to detect the end point of polishing rate (the amount of wafer material removed by polishing during a unit time interval) of the wafer surface during polishing.

BACKGROUND OF THE INVENTION

In recent years, chip manufacturing has increasingly relied upon multi-layer structures to fabricate integrated circuits or ICs. During multi-layer IC circuit manufacturing, it is necessary that each layer of the IC circuit structure on a semiconductor wafer be planarized to maintain controlled electrical properties.

Planarization is performed by CMP (chemical mechanical planarization) also referred to as chemical-mechanical polishing using a polishing machine that comprises a lower platen having a circular rotating plate on which a polishing pad is attached; and an upper platen that presses a wafer onto the polishing pad; and a means for supplying a polishing slurry.

A polishing machine utilizing CMP technology employs a method for measuring the polishing rate while a wafer surface is being polished. The method requires that a laser beam be emitted from the rear side (platen side) of the polishing pad toward the wafer surface to be polished, which requires a transparent window member on a part of the polishing pad to allow the laser beam to pass therethrough.

To improve slurry dispersibility on the pad body surface, one can provide perforations, which are a group of minute openings, on the entire pad surface. This method has a drawback in that, if the openings are formed on a window member, slurry may leak through these openings or may agglomerate in the openings, which creates noise during measurement of the polishing rate of a wafer and adversely impacts accuracy of these measurements. Conventional technology has overcome this drawback by keeping the window member free from perforations. Nonetheless, the manufacturing methods required to produce these pads are inefficient.

In view of these concerns, there is a desire to manufacture a polishing pad in an effective manner that eliminates the cumbersome perforation steps of conventional technologies required to avoid puncturing the transparent window.

SUMMARY OF THE INVENTION

The invention provides a method of forming a transparent polishing pad. The first step forms a plurality of openings through a disk-shaped pad body. The plurality of openings is distributed about the disk-shaped pad body and a transparent window within a portion of the pad body and the transparent window. Then sealing the openings in the transparent window with a transparent material allows transport of polishing fluids through the openings in the disk-shaped pad body and prevents transport of the polishing fluids through the transparent window.

DESCRIPTION OF PREFERRED EMBODIMENTS

The polishing pad of the present invention has openings extending through the width of the polishing pad on about an entire surface of the polishing pad body. These openings optimize the slurry retention and discharge capabilities of the pad. The pad thus provides improved polishing uniformity with an increased polishing rate. Furthermore, the openings formed on a window member are sealed with a transparent material, which resolves the issue of slurry agglomeration in the openings. Sealing with a transparent material includes either filling the openings with the transparent material or covering the openings with a transparent film that is adhesively attached thereto. Consequently, accuracy of polishing rate measurements is not affected by the sealing.

Figure 1:
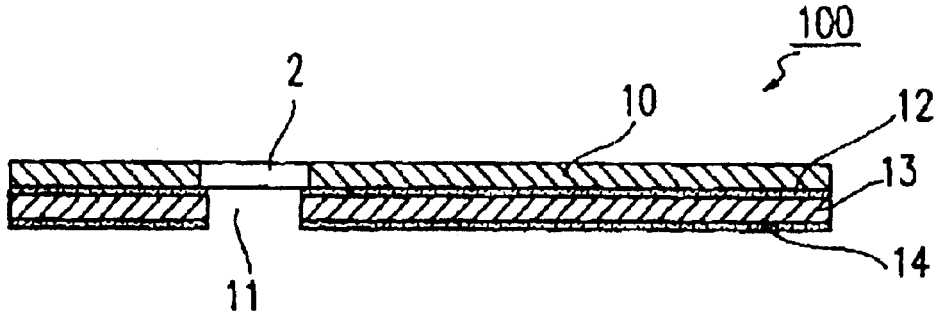
FIG. 1 is a cross section of working example 1 of the polishing pad.
Figure 2:
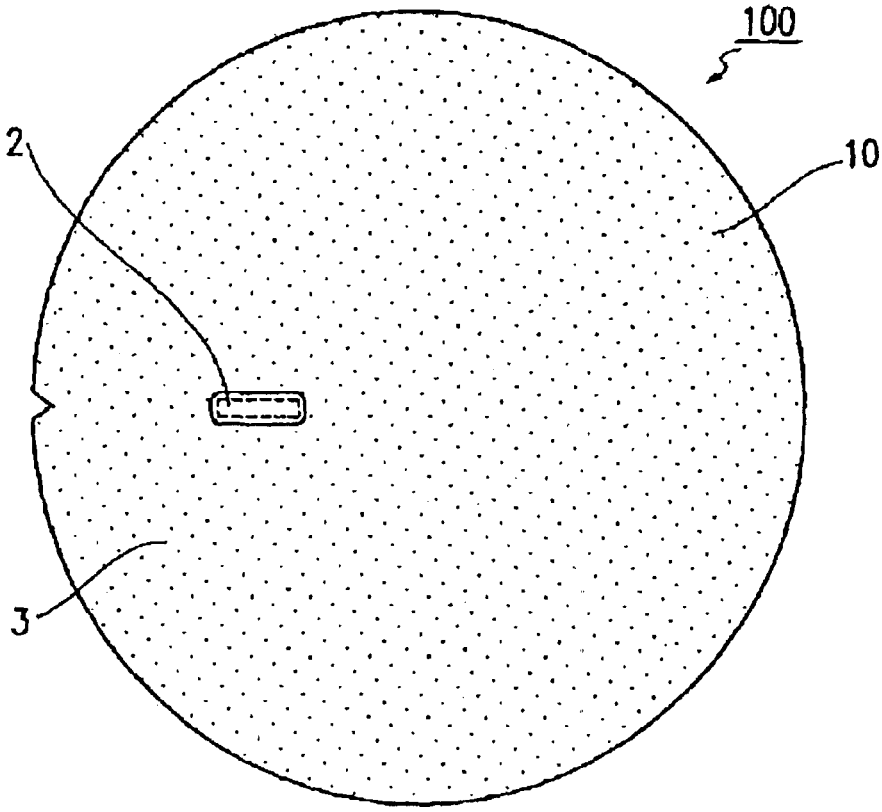
FIG. 2 is a plan view of the polishing pad illustrated in FIG. 1.

As illustrated in FIGS. 1 and 2, polishing pad 100 comprises: a pad body 10 and a transparent window member 2 integrally formed with a part of pad body 10. Pad body 10 is typically fabricated from a resin layer having minute pores.

Polishing pad 100 further comprises base layer 13 fabricated from a foamed layer and the like via pressure sensitive adhesive layer 12 on the rear side of pad body 10. On its rear surface, base layer 13 is laminated with a separation sheet (not illustrated) via pressure sensitive adhesive layer 14. The separation sheet is peeled so that pressure sensitive adhesive layer 14 can be stuck to a platen to prepare polishing pad 10 for planarization.

Pad body 10 is advantageously fabricated from one or more resins such as urethane, acrylic, polycarbonate, polyamide, polyester, and the like by a known casting or extrusion molding method, and the like. Most advantageously, pad body 10 is made of a thermoplastic resin among the above resins by the casting or extrusion molding method. However, it may also be made of a thermosetting resin by heating and curing the same.

Materials that window member 2 can be made of include those that pad body 10 advantageously include transparent resins such as polyvinyl chloride, poly (vinylidene fluoride). polyether sulfone, polystyrene, polyethylene, polytetrafluoroethylene, and the like. Any of these resins can be either cast molded or extrusion molded and cut into a desired size or thickness to provide window member 2.

The openings 3 are formed about an entire surface of pad body 10 as described above. The desirable inner diameter of the openings 3 is 1–3 mm and the desirable density of the same is 2–5 openings/$cm^2$. The openings in window member 2 are filled with a transparent material 4. Transparent material 4 advantageously is a resin selected from the group consisting of polyurethane, polyester, acrylic, polycarbonate, nylon, polyvinyl chloride, poly (vinylidene fluoride), polyether sulfone, polyethylene, polystyrene, polytetrafuloloethylene, and the like. Alternatively, the same resin as that making up window member 2 may be filled into the openings 3 and cured to provide transparent material 4.

As described, the openings 3 are filled with a transparent material 4 followed by sealing thereof. This keeps the openings 3 free from slurry migration so that agglomerated slurry will not cause noise when a laser beam passes through openings 3.

Alternatively, a plurality of grooves may be formed on pad body 10 by a conventional method. The shape, size, or pattern of the grooves may be changed in accordance with one's objective. The grooves may be multiple concentric circles, for example.

Figure 3:
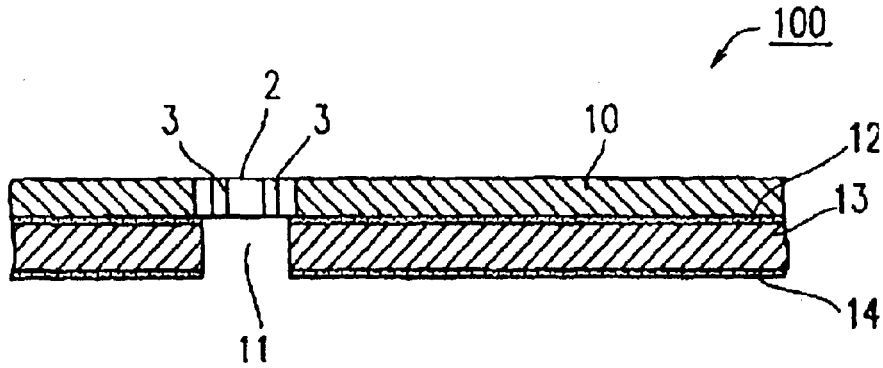
FIG. 3 is an enlarged cross section of the opening portion of the polishing pad illustrated in FIG. 2.
Figure 4:
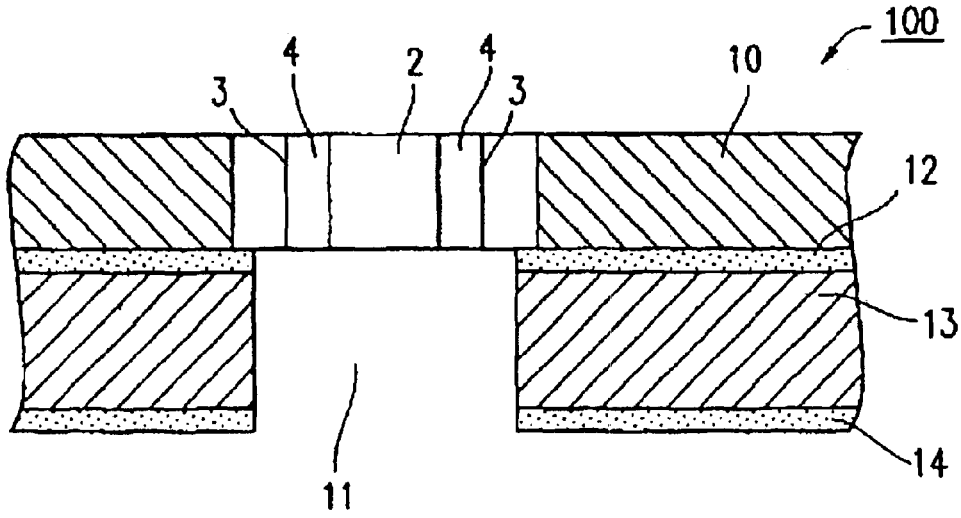
FIG. 4 is an enlarged cross section of the opening portion of the polishing pad illustrated in FIG. 2.

Referring to FIGS. 3 and 4, a working example of the manufacturing method for the polishing pad is described herein.

Pad sheet materials may be obtained by the steps comprising: placing a block of transparent member constituting window member 2 in a mold; cast molding an opaque resin constituting pad body 10 in a mold to make a molded material; and slicing [sic, splitting] the molded material. Alternatively, when one intends to obtain a single polishing pad sheet in every batch, window member 2 may be poured in a mold followed by casting an opaque resin for pad body 10 in a mold.

The pad body 10 thus obtained is, then, perforated by a perforator in a manner such that the openings 3 are provided on an entire surface of pad body 10.

Next, polishing pad body 10 is laminated in the order of pressure sensitive adhesive layer 12, base layer 13, pressure sensitive adhesive layer 14, and a separation sheet to make polishing pad 100. Base layer 13 is provided with an aperture 11 at the location of window member 2.

Polishing pad 100 has many openings 3 that allow uniform distribution of polishing slurry supplied between the material to be polished with pad body 10 of polishing pad 100. Uniform polishing is thus ensured, consequently eliminating the possibility of adversely affecting accurate measurements of polishing rate.

Figure 5:
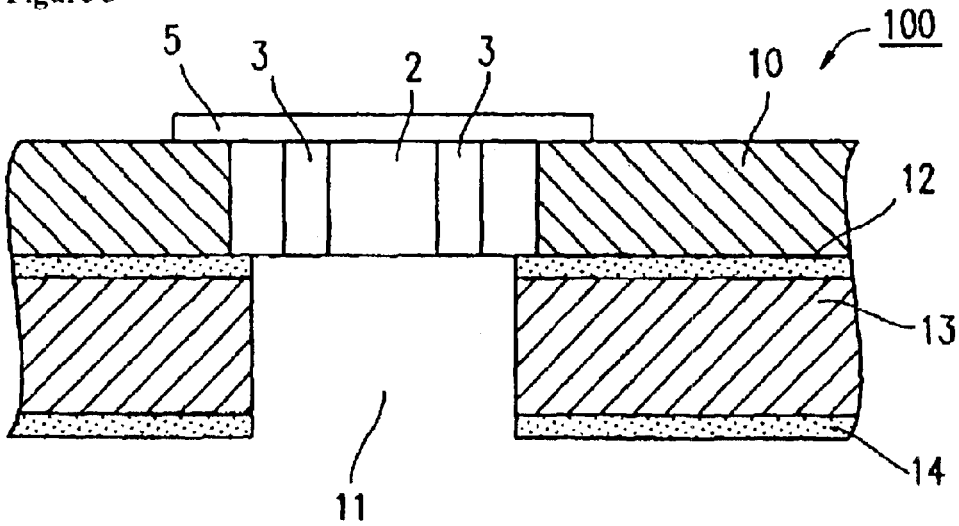
FIG. 5 is an enlarged cross section of the opening portion of an alternate working example of the polishing pad.

Note that in the above working example, the openings in window member 2 were filled with a resin; however, transparent film 5 such as a resin film, may also be adhesively attached to the front or rear surface of window member 2 as illustrated in FIG. 5. Covering the front, rear or both surfaces of the window seals openings 3 protects the window member 2. Most advantageously, the transparent film covers the front and rear of the window to prevent flow of the slurry into these openings. Transparent material 4 may also be used for transparent film 5, which most advantageously is the same resin that window member 2 is made of. For example, when window member 2 is made of polyurethane, it is desirable that the transparent film 5 be made of polyurethane; and when window member 2 is made of polyester, it is advantageous that the transparent film 5 also be made of polyester resin film.

The present invention suppresses slurry agglomeration in the openings in a window member, and therefore does not affect the detection accuracy of polishing rate. Unlike polishing pads of conventional technology, the method does not require avoiding the window member when the pad body surface is perforated. This facilitates improved productivity for pad manufacturing.

We claim:

1. A method of forming a transparent polishing pad comprising the steps of:

forming a plurality of openings through a disk-shaped pad body, the plurality of openings being distributed about the disk-shaped pad body and a transparent window within a portion of the pad body; and sealing the openings in the transparent window with a transparent material for allowing transport of polishing fluids through the openings in the disk-shaped pad body and preventing transport of the polishing fluids through the transparent window.

2. The method of claim 1 wherein the sealing includes filling the openings in the transparent window with the transparent material.

3. The method of claim 2 wherein the transparent material is a resin material selected from the group consisting of polyurethane, polyester, acrylic, polycarbonate, nylon, polyvinyl chloride, poly (vinylidene fluoride), polyether sulfone, polyethylene, polystyrene and polytetrafluoroethylene.

4. The method of claim 3 wherein the transparent window and transparent material are formed from the same resin material.

5. The method of claim 1 wherein the transparent material is a film and the sealing includes covering the openings in the transparent window with the transparent material.

6. The method of claim 5 wherein the transparent material is a resin material selected from the group consisting of polyurethane and polyester.

7. The method of claim 5 wherein the transparent window and transparent material are formed from the same resin material.

* * * * *